United States Patent [19]

Heitmann

[11] 4,175,570

[45] Nov. 27, 1979

[54] APPARATUS FOR BUILDING A CONTINUOUS TOBACCO STREAM

[75] Inventor: Uwe Heitmann, Schwarzenbek, Fed. Rep. of Germany

[73] Assignee: Hauni-Werke Körber & Co., KG., Hamburg, Fed. Rep. of Germany

[21] Appl. No.: 795,560

[22] Filed: May 10, 1977

[30] Foreign Application Priority Data

May 26, 1976 [DE] Fed. Rep. of Germany ..... 2623547

[51] Int. Cl.[2] ..... A24C 5/39; B65G 53/30; A24B 7/14

[52] U.S. Cl. ..... 131/84 B; 131/108; 131/110; 406/82

[58] Field of Search ..... 131/84 B, 110, 21 A, 131/21 R, 108; 302/17-22, 37, 23, 24, 25

[56] References Cited

U.S. PATENT DOCUMENTS

| | | | |
|---|---|---|---|
| Re. 29,042 | 11/1976 | David | 131/21 A |
| 4,041,958 | 8/1977 | Wahle | 131/84 B |

FOREIGN PATENT DOCUMENTS

| | | | |
|---|---|---|---|
| 2267965 | 11/1975 | France | 302/24 |

*Primary Examiner*—Robert W. Michell
*Assistant Examiner*—V. Millin
*Attorney, Agent, or Firm*—Peter K. Kontler

[57] ABSTRACT

Apparatus for building a continuous tobacco stream at the underside of the lower reach of an endless foraminous conveyor belt has an upright duct with an inlet at or close to the lower end and a narrow channel-like outlet below the lower reach of the belt. A feeding device supplies tobacco particles into the inlet of the duct, preferably in a direction to cause the particles to move toward the outlet. One side wall of the duct has elongated openings which make an acute angle with the direction of movement of the lower reach of the belt and discharge currents of compressed air which accelerate and advance the particles toward the underside of the lower reach in such a way that the direction of movement of particles in the outlet of the duct has a component of movement in the direction of lengthwise movement of the lower reach. The currents of air accelerate and advance the particles independently of the feeding device. The latter can be assisted by additional currents of compressed air which are admitted into the inlet and are evacuated, at least in part, at the level of the openings in the side wall of the duct. A suction chamber above the lower reach of the belt attracts the particles to the underside of the lower reach or against the particles of the growing tobacco stream at the underside of the lower reach. The rate of evacuation of air from the suction chamber exceeds the rate of admission of compressed air through the openings in the side wall of the duct.

14 Claims, 5 Drawing Figures

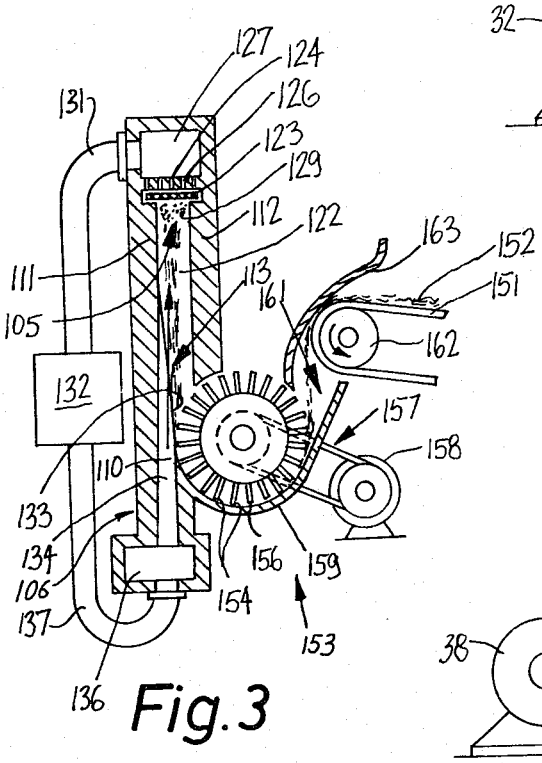
Fig.3
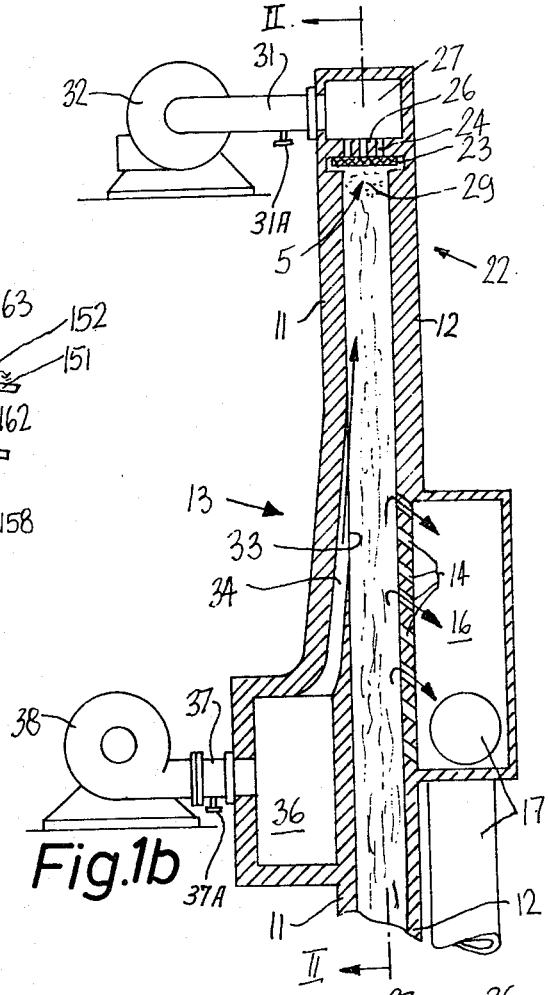
Fig.1b
Fig.2
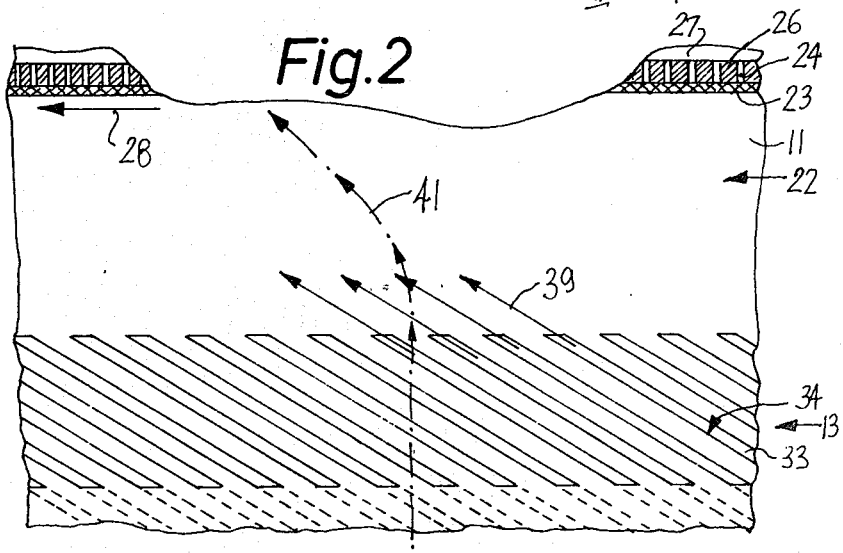

APPARATUS FOR BUILDING A CONTINUOUS TOBACCO STREAM

CROSS-REFERENCE TO RELATED CASE

The apparatus of the present invention constitutes an improvement over and a further development of apparatus which are disclosed in commonly owned U.S. Reissue Pat. No. 29,042 granted Nov. 23, 1976 to Harry David.

BACKGROUND OF THE INVENTION

The present invention relates to apparatus for building a continuous tobacco stream, and more particularly to improvements in apparatus of the type wherein the tobacco stream is built up at one side of an elongated reach of an endless foraminous conveyor and wherein the other side of the elongated reach is adjacent to a suction chamber serving to attract the particles to the one side of the reach or against the particles of the growing tobacco stream. In such apparatus, the elongated reach of the conveyor closes one end of a channel wherein the particles of tobacco advance under the action of mechanical propelling means or with a gaseous carrier medium, preferably air.

It is already known to provide stream forming apparatus of the above outlined character with means for causing tobacco particles which approach the foraminous conveyor to move in a direction having a component of movement in the direction of lengthwise movement of the elongated reach of the foraminous conveyor. This reduces the likelihood of rebounding of tobacco particles on impact against the conveyor or against the growing tobacco stream on the conveyor. Optimum conditions for the building of a satisfactory tobacco stream would be established if the aforementioned component of movement of tobacco particles were equal or would closely approximate the speed of forward or lengthwise movement of the tobacco collecting reach of the foraminous conveyor, i.e., if the relative movement between arriving tobacco particles and the foraminous conveyor and/or the growing stream were zero or close to zero. U.S. Pat. No. 3,030,965 discloses an apparatus wherein a current of air transports tobacco particles upwardly against the underside of the elongated lower reach of a foraminous belt conveyor. The particles are transported in a channel whose inclination with respect to the direction of movement of the lower reach is such that the paths of the particles (or at least of some of the particles) of tobacco are caused to make an acute angle with the direction of movement of the lower reach. The direction of movement of particles is constant all the way from the locus where they enter the tobacco channel to the underside of the lower reach of the foraminous conveyor. A suction chamber above the lower reach of the conveyor attracts the particles to the underside of the lower reach or to the particles of the tobacco stream which grows at the underside of such lower reach.

A drawback of the just described conventional stream building apparatus is that the foraminous conveyor will accumulate a satisfactory tobacco stream only as long as its speed is below a certain relatively low limit. Once the speed limit is exceeded, a satisfactory stream would develop only if the speed of ascending air were increased beyond a value which can be achieved in such types of apparatus. The speed of the air current is limited by the relatively small cross-sectional area of the tobacco channel wherein the particles of tobacco advance toward the lower reach of the foraminous conveyor and also by the resistance which the foraminous conveyor and the growing tobacco stream thereon offer to the passage of ascending air currents into the suction chamber. Furthermore, the angle between the tobacco channel and the lower reach of the foraminous conveyor cannot be reduced at will for a number of reasons.

OBJECTS AND SUMMARY OF THE INVENTION

An object of the invention is to provide an apparatus which can build a satisfactory tobacco stream even if the speed of lengthwise movement of the foraminous conveyor is increased well above the maximum permissible speed in heretofore known apparatus.

Another object of the invention is to provide an apparatus which can build a homogeneous tobacco stream at a rate which cannot be matched by resorting to conventional apparatus.

A further object of the invention is to provide the apparatus with novel and improved means for transporting tobacco particles to the foraminous conveyor and with novel and improved means for changing the direction of movement of tobacco particles on their way toward the conveyor.

An additional object of the invention is to provide an apparatus which can be used as a simpler, more compact, more reliable and more efficient substitute for conventional tobacco distributors in machines for the manufacture of plain cigarettes or the like.

An ancillary object of the invention is to provide a novel and improved tobacco feeding device for use in the above outlined apparatus.

Another object of the invention is to provide an apparatus wherein air or another gaseous fluid which is used to accelerate and advance tobacco particles toward the foraminous conveyor need not be maintained and supplied at a greatly elevated pressure.

The invention is embodied in an apparatus for building a continuous tobacco stream. The apparatus comprises a magazine or an analogous source of tobacco particles (e.g., tobacco shreds), an endless driven foraminous conveyor having an elongated portion or reach, a suction chamber disposed at one side of the conveyor portion (e.g., at the upper side of such portion), an elongated duct having an inlet remote from the foraminous conveyor and an outlet which is adjacent to the conveyor portion, means for feeding tobacco particles from the source into the duct by way of the inlet, and means for accelerating and advancing the particles in the duct toward the outlet and against the other side of the conveyor portion independently of the feeding means. The duct has a wall which is provided with one or more openings (e.g., elongated slots which make an acute angle with the direction of movement of the conveyor portion), and the advancing means includes a source of compressed gaseous fluid (preferably air) and means for supplying compressed fluid from the last mentioned source to the opening or openings in the wall of the duct.

The outlet may constitute a narrow channel which is elongated in the directon of movement of the conveyor portion. The means for supplying compressed fluid to the opening or openings in the wall of the duct preferably includes means for admitting to the opening or openings one or more currents of compressed gaseous fluid each having a component of movement in the direction of movement of the conveyor portion. The opening or openings are preferably located in close or immediate proximity of the conveyor portion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a sectional view as seen in the direction of arrows from the line II—II of FIG. 1*b;*

FIG. 3 is a fragmentary vertical sectional view of a second stream building apparatus having a modified tobacco feeding unit.

DESCRIPTION OF THE PREFERRED EMBODIMENTS

Figure 1A:
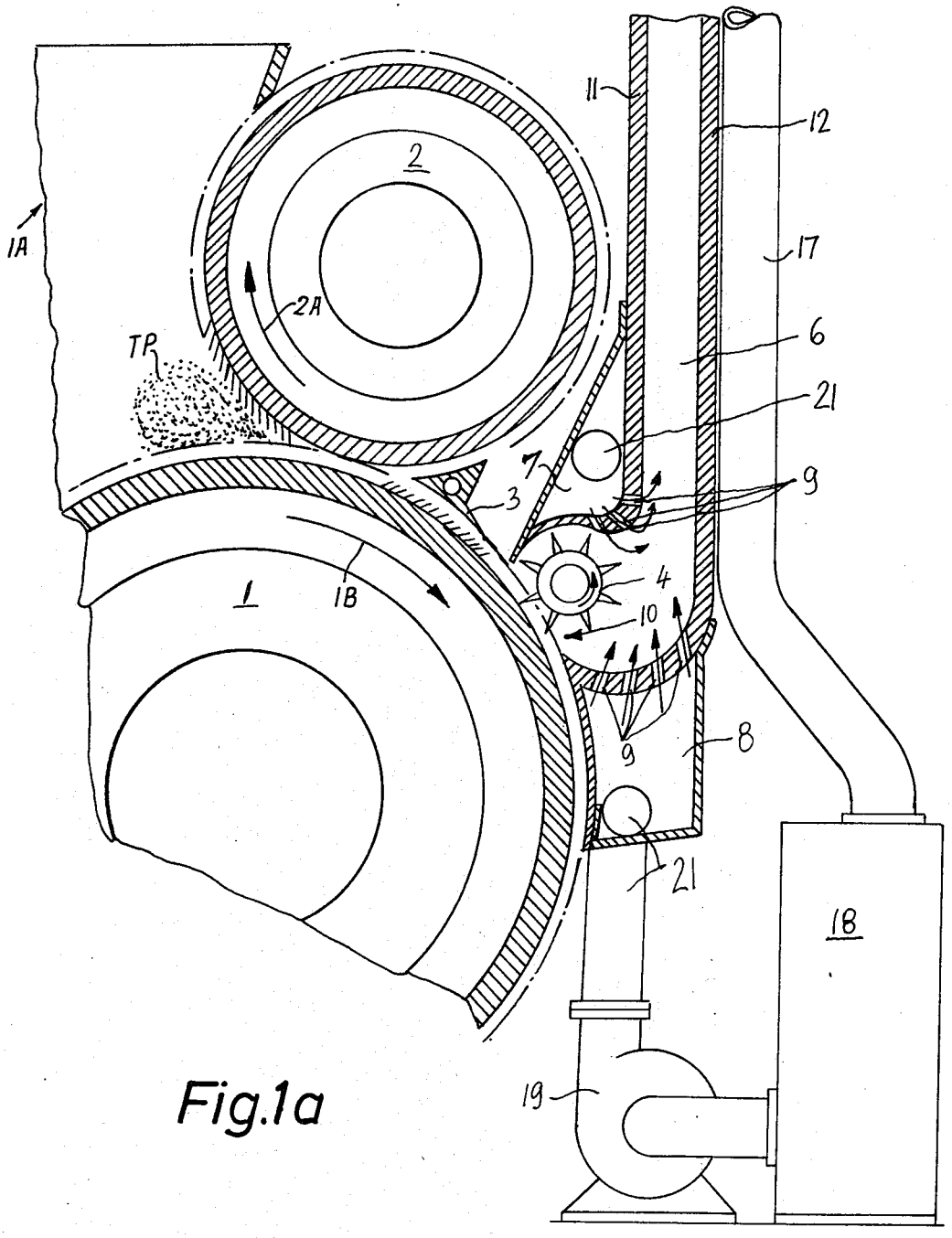
FIG. 1 (composed of FIGS. 1*a* and 1*b*) is a partly elevational and partly vertical sectional view of a stream building apparatus which embodies one form of the invention.

Referring to FIGS. 1*a* and 1*b*, FIG. 1*a* shows a carded rotary drum-shaped conveyor 1 which removes a continuous layer of tobacco particles TP from a main supply in a magazine or hopper 1A and transports the layer in the direction indicated by arrow 1B. The surplus of tobacco particles is returned into the magazine 1A by a rotary carded refuser 2 which is driven in the direction indicated by arrow 2A. The equalized layer which advances beyond the refuser 2 is transported between and below the prongs of a stationary comb 3 which causes the particles (mainly tobacco shreds) to adhere to the carding of the conveyor 1. A rapidly rotating picker roller 4 expels successive increments of the layer from the carding of the conveyor 1 and into the inlet 10 of an upright duct 6 wherein the particles are caused to move upwardly into the range of a tobacco stream building unit 5. The inlet 10 of the duct 6 is flanked by two plenum chambers 7 and 8 which admit currents of compressed air via orifices 9 in the adjacent side walls 11 and 12 of the duct 6. At least some air which is admitted into the duct 6 via orifices 9 is evacuated by way of ports 14 (shown in FIG. 1*b*) which are provided in the side wall 12 and communicate with a suction chamber 16. The ports 14 are located substantially opposite an air admitting device 13 which supplies compressed air to the upper portion of the duct 6 through the side wall 11.

The suction chamber 16 is connected with the intake of a suction generating device 19 (preferably a blower) by an air evacuating pipe 17 which contains a suitable filter 18 serving to intercept tobacco dust. The pressure side of the blower 19 is connected with the plenum chambers 7 and 8 by an air supplying pipe 21.

The upper portion or outlet 22 of the duct 6 constitutes a narrow tobacco channel which supplies tobacco particles to the aforementioned stream building unit 5. The latter comprises an endless driven foraminous conveyor belt 23 whose elongated lower portion or reach moves at right angles to the plane of FIG. 1*b* and intercepts the particles which ascend in the channel 22 so that such particles form a growing tobacco stream 29. The lower portion or reach of the foraminous belt 23 slides along the underside of the perforated bottom wall 26 of a suction chamber 27 which is connected with the intake of a discrete suction generating device 32 (e.g., a blower) by an air evacuating pipe 31. The perforations 24 of the bottom wall 26 may constitute suitably distributed bores. The direction in which the belt 23 advances along the underside of the perforated wall 26 is indicated by the arrow 28 shown in FIG. 2.

The parts 1–4 constitute a mechanical feeding device which delivers tobacco particles TP from the source (magazine 14) into the inlet 10 at the lower end of the duct 6. The cross-sectional area of the lower portion of the duct 6 is substantially constant; however, the channel 22 is elongated, as considered in the direction of arrow 28. The length of this channel equals the length of the tobacco stream building zone at the underside of the lower reach of the belt 23.

The air admitting device 13 supplies currents of air into elongated slots 33 which are machined into the side wall 11 of the duct 6 and make an acute angle with the direction (arrow 28) of movement of the lower reach of the foraminous belt 23 (see FIG. 2). The slots 33 constitute discharge openings of elongated air admitting grooves or passages 34 in the side wall 11. The intake ends of the grooves 34 communicate with a source of compressed air including a plenum chamber 36 receiving compressed air from blower 38 by way of an air supplying pipe 37. The inclination of the major parts of passages 34 in the side wall 11 equals or approximates that of their discharge openings or slots 33.

The arrows 39 shown in FIG. 2 indicate the direction of flow of air which issues from the slots 33. The phantom line 41 denotes the path of a tobacco particle; it will be noted that the path extends vertically upwardly in the region below the slots 33 and that the particle thereupon changes the direction of its movement so that such direction includes a vertical component toward the suction chamber 27 and a horizontal component which is parallel to the direction (arrow 28) of movement of the lower reach of the foraminous belt 23. The air admitting device 13 constitutes a means for accelerating and advancing the particles TP in the duct 6 toward the channel 22 and against the underside of the lower reach of the belt 23. The openings or slots 33 can be machined into the side wall 11 in immediate or close proximity to the belt 23.

The pipes 31 and 37 contain flow restrictors which are respectively adjustable by means of handgrip members 31A, 37A so as to insure that the rate of air flow from the channel 22 into the suction chamber 27 exceeds the rate of air flow from the plenum chamber 36 into the duct 6. This prevents turbulence and/or a rise of air pressure in the channel 22. If the blower 32 or 38 is omitted, the pressure side of the remaining blower is connected to the pipe 37 and the intake of the remaining blower is connected to the pipe 31. Also, the pipe 37 can be replaced with a series of discrete pipes each of which contains a separate shutoff and/or adjustable throttle valve to regulate the rate of air flow into the plenum chamber 36 and thence into the duct 6 via slots 33.

The operation:

The conveyor 1 of the tobacco feeding device draws an unequalized layer of tobacco particles TP from the main supply in the magazine 1A and the carding of the refuser 2 returns the surplus into the magazine. The prongs of the comb 3 bear against the particles between the rows of projections which constitute the carding of the conveyor 1. The rapidly rotating picker roller 4 propels tobacco particles constituting successive increments of the equalized layer into the lower end portion of the duct 6 via inlet 10, and such particles are entrained by the currents of compressed air issuing from the plenum chambers 7 and 8 via orifices 9. At least some air which is admitted via orifices 9 is evacuated from the channel 6 by flowing into the suction chamber 16 through the ports 14 in the side wall 12. The inclination of ports 14 is counter to the direction of air flow in the duct 6 so that the currents which flow into these ports must change direction; thus insures that the ports 14 are not clogged by ascending tobacco particles whose inertia and kinetic energy suffice to insure further upward movement into the channel 22. The lowermost port or ports 14 are preferably located at a level at least slightly below the slots 33 in the side wall 11.

The currents of air which issue from the slots 33 (arrows 39) accelerate the ascending tobacco particles and simultaneously deflect the particles in a manner as indicated by the phantom-line arrow 41 of FIG. 2. The inclination of passages 34 and the rate of air admission via slots 33 are related to the speed of forward movement of the lower reach of the belt 23 in such a way that, when a particle impinges upon the belt 23 or upon the growing tobacco stream 29, the horizontal component of movement of such particle equals or closely approximates the speed of the belt 23. In the embodiment of FIGS. 1*a*, 1*b* and 2, the direction (arrows 39) in which the currents of air issue from the slots 33 makes an angle of 30 degrees with the plane of the lower reach of the belt 23, and the direction of movement of deflected particles (see the upper portion of the arrow 41 in FIG. 2) makes an angle of approximately 45 degrees with the direction indicated by the arrow 28. Since the suction chamber 27 evacuates air at a rate exceeding the rate of air admission into the channel 22 via slots 33, air cannot pile up in the channel 22 even if the ports 14 cannot evacuate the entire amount of air which is admitted via orifices 9. Also, and since the device 13 preferably admits currents of compressed air immediately into the channel 22 (close to the unit 5), the currents which are admitted via slots 33 insure that all or nearly all particles of tobacco travel along paths which are identical with or similar to that indicated by the arrow 41, i.e., each particle has a component of movement in the direction indicated by the arrow 28 and such component equals or approximates the speed of the belt 23.

FIG. 3 shows a portion of a modified apparatus wherein all such parts which are identical with or clearly analogous to corresponding parts of the apparatus of FIGS. 1*a*, 1*b*, 2 are denoted by similar reference characters plus 100. The main difference between the two apparatus is that the apparatus of FIG. 3 comprises a modified device 153 for feeding tobacco particles into the duct 106, and more particularly directly into the lower end of the tobacco channel 122. The suction chamber 16 is omitted. The feeding device 153 comprises a wide endless band conveyor 151 which is trained over pulleys 162 (one shown) and whose upper reach delivers a wide layer 152 of tobacco particles against a suitably configurated baffle 163. The latter converts the layer into a shower whose particles descend in a funnel 161 and into the range of a rapidly rotating tobacco propelling rotary member or wheel 156 having radially outwardly extending needles 154 or analogous tobacco propelling elements. The wheel 156 is driven by a separate prime mover 158 (e.g., a variable-speed electric motor) through the medium of an endless belt or chain 157. The elements 154 entrain the particles of tobacco along the concave surface of a stationary guide or trough 159 and deliver them into the inlet 110 of the duct 106. The elements 154 accelerate the particles of tobacco and also change the direction of movement of such particles through approximately 180 degrees. Each element 154 may constitute an elastic bristle, a paddle or vane made of leather, or a steel pin. The speed of the motor 158 may be changed or selected independently of the speed of other moving parts of the apparatus. The trough 159 may consist of sheet metal. The funnel 161 is defined by the upstream portion of the trough 159 and by the downstream portion of the baffle 163. The trough 159 surrounds the wheel 156 along an arc of less than 180 degrees, and the center of curvature of its concave surface is preferably located on or close to the axis of the wheel 156. The downstream portion of the trough 159 extends substantially tangentially of the wheel 156 and is located opposite the air admitting device 113. The side wall 111 is substantially tangential to an imaginary extension of the downstream portion of the trough 159 across the channel 122.

The manner in which currents of compressed air issuing from the slots 133 accelerate and change the direction of tobacco particles in the channel 122 is the same as or analogous to that described in connection with the first embodiment of the apparatus.

The plenum chamber 136 is located at the lower end of the duct 106 and is connected to the pressure side of the blower 132. The intake of this blower is connected with the suction chamber 127 by the air evacuating pipe 131.

Figure 4:
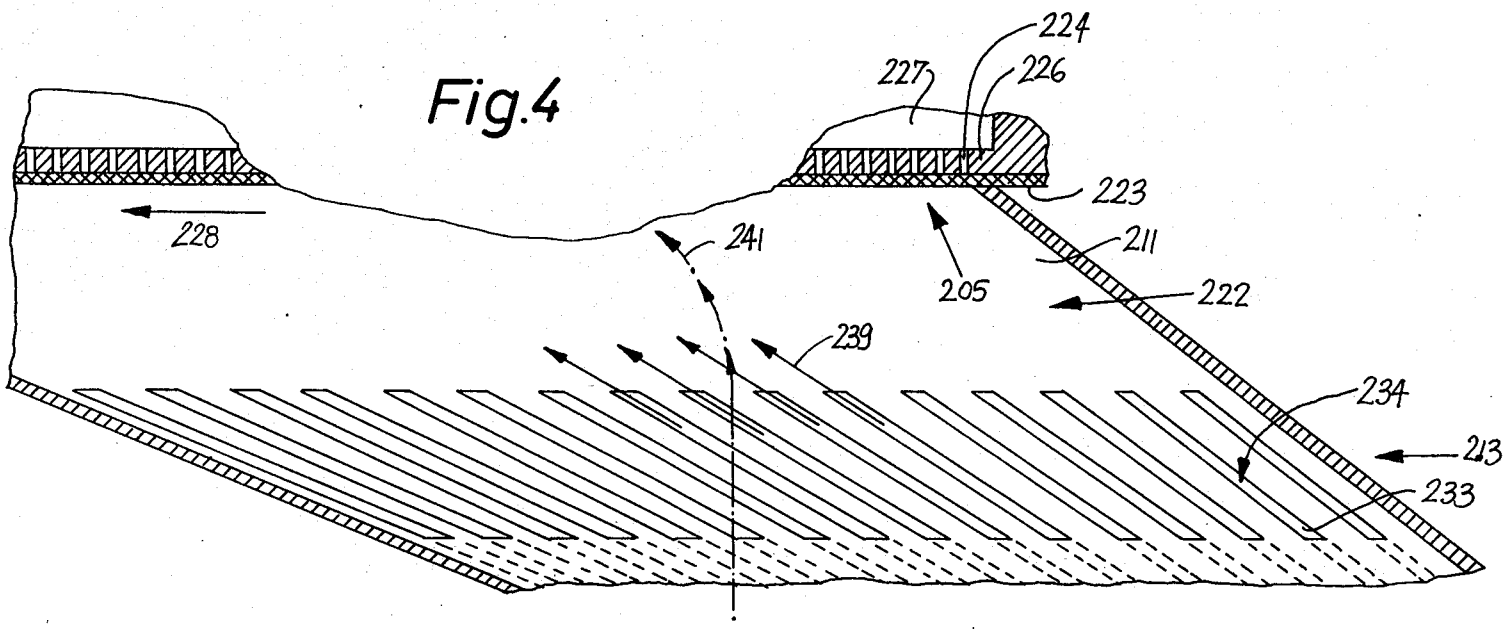
FIG. 4 is a sectional view, similar to that of FIG. 2, of a portion of a third stream building apparatus.

FIG. 4 shows a portion of a third apparatus wherein the passages 234 and their discharge openings or slots 233 are not exactly parallel to each other. The inclination of successive passages 234 and slots 233 with respect to the lower reach of the foraminous conveyor belt 223 decreases, as considered in the direction indicated by arrow 228. In other words, the currents of compressed air which issue from the slots 233 (see the arrows 239) diverge while flowing toward the suction chamber 227. All such parts which are identical with or clearly analogous to those of the apparatus of FIGS. 1*a*, 1*b* and 2 are denoted by similar reference characters plus 200. The provision of a device 213 which admits to the channel 222 divergent currents of air insures that the particles of tobacco which rise in the channel 222 toward the foraminous belt 223 are not likely to be interlaced with each other; this, in turn, enhances the quality of the tobacco stream which grows at the underside of the belt 223. In fact, the divergent passages 234 and their slots 233 not only prevent any interlacing of tobacco particles in the channel 222 but actually promote the separation of interlaced particles in the region below the belt 223.

An important advantage of the improved apparatus is that the particles which reach the foraminous belt of the stream building unit are not likely to move relative to the belt and/or relative to the growing tobacco stream on such belt, even if the speed of the belt is very high, i.e., when the belt is driven at a speed which is needed to form a continuous tobacco stream at a rate necessary to meet the requirements of a cigarette maker which turns out at least 4,000 plain cigarettes per minute. It has been found that the movement of tobacco particles relative to the foraminous belt and/or relative to the particles of the growing stream is negligible, even within the maximum speed range of the belt. This enhances the quality of the stream; in fact, the quality of the stream is often sufficient to warrant its draping into cigarette paper or other wrapping material without any or with negligible trimming.

It is clear that the apparatus can be modified to deliver tobacco particles onto the upper reach of a foraminous belt. The construction which is shown in the drawing (wherein the inlet of the duct is located below the outlet) is preferred at this time because it contributes to compactness of the apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for building a continuous tobacco stream, comprising a source of tobacco particles; an endless driven foraminous conveyor having an elongated portion; a suction chamber at one side of said portion; a duct having an inlet and an outlet which constitutes a narrow channel and is adjacent to the other side of said portion and is elongated in the direction of movement of said portion; means for feeding tobacco particles from said source into said duct by way of said inlet; and means for accelerating and advancing the particles in said duct toward said outlet and against the other side of said portion independently of said feeding means, said duct having a wall provided with at least one opening which is immediately adjacent to said portion of said conveyor and said advancing means including a source of compressed gaseous fluid and means for supplying compressed fluid from said last mentioned source to said opening, said supplying means including means for admitting to said opening a current of compressed fluid having a component of movement in said direction and said advancing means further comprising means for transporting tobacco particles from said inlet into the range of said current.

2. Apparatus as defined in claim 1, wherein said wall has a plurality of openings each of which is an elongated slot making an acute angle with said direction.

3. Apparatus as defined in claim 1, wherein said last mentioned source includes a plenum chamber and said wall has a plurality of openings, said fluid admitting means comprising elongated passages connecting said plenum chamber with said openings and making an acute angle with said direction.

4. Apparatus as defined in claim 3, wherein said passages diverge in a direction toward said portion of said foraminous conveyor.

5. Apparatus as defined in claim 1, further comprising means for evacuating air from said chamber at a rate exceeding the rate of admission of fluid via said opening.

6. Apparatus as defined in claim 1, wherein said means for transporting tobacco particles from said inlet into the range of said current comprises means for admitting to said duct additional compressed fluid in the region of said inlet whereby such additional fluid flows toward said suction chamber and entrains the particles of tobacco into the range of compressed fluid which is admitted via said opening.

7. Apparatus as defined in claim 6, further comprising means for evacuating from said duct at least some of the fluid which is admitted in the region of said inlet.

8. Apparatus as defined in claim 7, wherein said evacuating means includes a second suction chamber and said duct has at least one port disposed at the general level of said opening and connecting the interior of said duct with said second suction chamber.

9. Apparatus as defined in claim 1, wherein said feeding means comprises a rotary member having a plurality of peripheral tobacco propelling elements and means for admitting tobacco particles into the range of said elements.

10. Apparatus as defined in claim 9, wherein said feeding means further comprises a stationary guide having a concave surface surrounding a portion of said rotary member, said guide having a portion disposed substantially tangentially of said duct and bounding a portion of said inlet.

11. Apparatus as defined in claim 10, wherein the center of curvature of said surface is located on the axis of said rotary member.

12. Apparatus as defined in claim 10, wherein said admitting means includes a funnel and said guide has a second portion forming part of said funnel.

13. Apparatus as defined in claim 1, wherein said outlet is located at a level above said inlet and said second side is the underside of said portion of said foraminous conveyor.

14. Apparatus as defined in claim 13, wherein said duct includes a lower portion of substantially constant cross-sectional area and said outlet constitutes a channel whose width increases in the direction of movement of said portion of said foraminous conveyor.

* * * * *